United States Patent [19]

Inoue et al.

[11] 4,156,245

[45] May 22, 1979

[54] HIGH FREQUENCY CARRIER ELECTRIC RECORDING PROCESS

[75] Inventors: Eiichi Inoue, Tokyo; Takashi Yamaguchi, Yokohama; Nobuhiro Miyakawa, Kobe, all of Japan

[73] Assignee: Mita Industrial Company Ltd., Osaka, Japan

[21] Appl. No.: 796,415

[22] Filed: May 12, 1977

[30] Foreign Application Priority Data

May 26, 1976 [JP] Japan ..... 51/59984

[51] Int. Cl.[2] ..... G03G 15/00; B05B 5/02

[52] U.S. Cl. ..... 346/153; 118/657

[58] Field of Search ..... 346/153, 155, 162; 358/300; 118/657

[56] References Cited

U.S. PATENT DOCUMENTS

| | | | |
|---|---|---|---|
| 3,528,073 | 9/1970 | Starr, Jr. | 346/153 |
| 3,534,383 | 10/1970 | Tsukatani | 346/153 |
| 3,872,480 | 3/1975 | Englebrecht | 346/153 |

OTHER PUBLICATIONS

*Xerography*, Dessaur & Clark, Focal Press, 1965, pp. 266, 442.

IBM Tech. Disc. Bull., p. 1090, vol. 9, #9, Feb. 1967, "Mag. Brush Developer"–Cross et al.

*Primary Examiner*—Jay P. Lucas

*Attorney, Agent, or Firm*—Sherman & Shalloway

[57] ABSTRACT

In the electric recording process comprising relatively moving a pair of a recording electrode and a counter electrode and an electrostatic recording material electrically connected between said two electrodes, applying an electric recording signal between said two electrodes to form an electrostatic image on the electrostatic recording material, developing the so formed electrostatic image with a developer and, if desired, fixing the developed image, when a high frequency signal formed by amplifying and modulating an image signal is applied as the electric recording signal and the electrostatic image formed on the electrostatic recording material is developed with an electroconductive powdery developer containing a fine powder of a magnetic material, high quality recorded images free of such troubles as blurring, tailing, fogging and Moiré can be obtained even at high recording speeds.

8 Claims, 8 Drawing Figures

Fig. 1-A
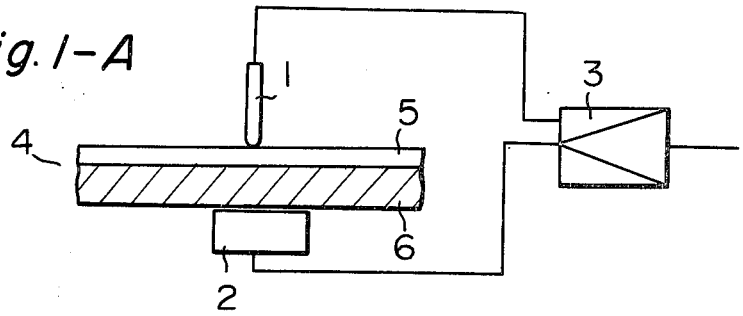
Fig. 1-B
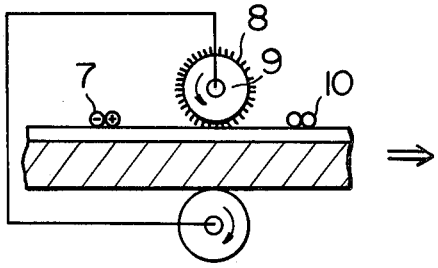
Fig. 1-C
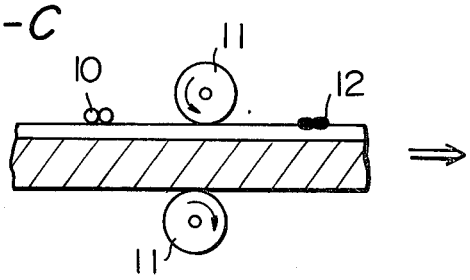

Fig. 2-A
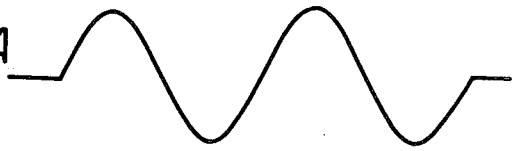
Fig. 2-B
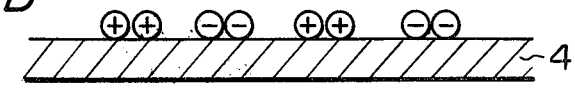
Fig. 2-C
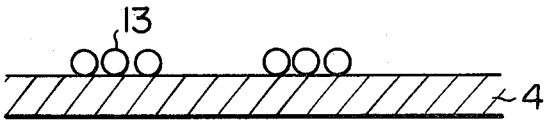
Fig. 2-D
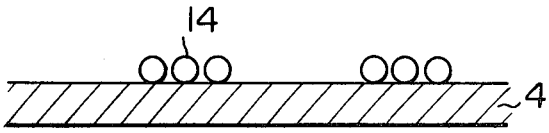
Fig. 2-E
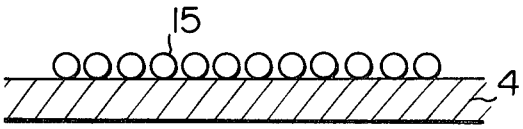

HIGH FREQUENCY CARRIER ELECTRIC RECORDING PROCESS

BACKGROUND OF THE INVENTION (1) Field of the Invention

The present invention relates to an electric recording process. More particularly, the invention relates to an electric recording process in which such troubles as blurring, tailing, fogging and Moiré can be effectively eliminated by applying as electric recording signals high frequency signals formed by amplifying and modulating image signals and using a magnetic electroconductive developer as the developer for developing an electrostatic image formed on an electrostatic recording material.

(2) Description of the Prior Art

As the conventional electric recording process, there is known a process comprising moving relatively a pair of a recording electrode and a counter electrode and an electrostatic recording material electrically connected between the two electrodes, applying an electric recording signal between the two electrodes to form an electrostatic latent image on the eletrostatic recording material, developing the so formed electrostatic latent image with a developer and, if desired, fixing the developed image.

In general, direct current signals are used as the electric recording signal to be applied in this known electric recording process. However, a high-voltage direct current applied to a recording stylus not only forms a latent image on the recording surface but also causes such troubles as so-called "blurring", "tailing" and "fogging". For example, Messrs. Haneda, Ito and Hashigami teach that simultaneously with formation of a latent image as mentioned above, charges of the opposite polarity, which are deemed to be due to influences of induction or electric force lines, are accumulated in the vicinity of the latent image to cause "blurring", when the recording stylus is moved, charges accumulated on the recording stylus and other recording equipments are applied and transferred to the recording surface to cause "tailing", and that because of the potential forming the latent image, the entire recording surface is charged at the same polarity as that of the latent image, though the intensity of charging is lower than in the latent image and this charging results in "fogging" (see the Journal of the Electrophotographic Association, April 1970, pages 37 to 43). Accordingly, in a final image obtained by the electrostatic recording process using a high-voltage direct current as the electric recording signal, the resolving power is reduced by the above-mentioned undesirable phenomena such as blurring, tailing and fogging and the image becomes obscure. Further, when recording is carried out at a high speed, namely when the relative scanning speed of the recording stylus and recording material is enhanced, the above defect becomes especially conspicuous.

Methods using as electric recording signals high frequency signals formed by amplifying and modulating image signals have already been proposed in Japanese Patent Publications Nos. 33516/71 and 21311/65. It is taught that according to the method disclosed in the former patent publication, since charges of different polarities are alternately applied, charges oriented in the vertical direction of a recording paper are not formed and a powdery developer is uniformly stuck to either the peripheral portion or the central portion of a latent image on the recording paper, whereby the edge effect is eliminated and an image of good quality is obtained. The latter patent publication discloses that according to the claimed alternating current recording method, the entire circuit structure can be simplified, any developer can be used irrespective of the polarity of the toner and an image having a sufficient resolving power is obtained.

According to the known alternating current recording method, however, since alternating charges in which the polarity is changed alternately at every half cycle are formed on the recording surface, a great number of very fine white spots, namely so-called dots, are formed on a final image, and as a result, the image density is drastically reduced and a Moiré fringe, namely a periodical change of the density not present in the original, which is generated at certain beats of dot and line densities depending on the value of the line density, is caused to appear on the final image.

BRIEF SUMMARY OF THE INVENTION

We made research works on the electric recording process with a view to eliminating or moderating the foregoing defects involved in the conventional methods. As a result, we found that when an electrostatic latent image formed by the above-mentioned alternating current recording method is developed with a magnetic electroconductive powdery developer detailed hereinafter, all of the foregoing defects such as blurring, tailing, fogging and Moiré can be eliminated at a stroke and a clear recorded image can be obtained. We have now completed the present invention based on this finding.

It is therefore a primary object of the present invention to provide an electric recording process characterized by a novel combination of an alternating recording current and a magnetic electroconductive powdery developer.

Another object of the present invention is to provide an electric recording process in which such troubles as blurring, tailing, fogging and Moiré can be effectively eliminated and an image excellent in the contrast, resolving power and gradation can be obtained.

Still another object of the present invention is to provide an electric recording process in which electric recording can be performed at a scanning speed much higher than the scanning speeds adopted in the known electric recording processes.

In accordance with the fundamental aspect of the present invention, there is provided an electric recording process comprising relatively moving a pair of a recording electrode and a counter electrode and an electrostatic recording material electrically connected between said two electrodes, applying an electric recording signal between said two electrodes to form an electrostatic image on the electrostatic recording material, developing the so formed electrostatic image with a developer and, if desired, fixing the developed image, said process being characterized in that a high frequency signal formed by amplifying and modulating an image signal is applied as the electric recording signal and the electrostatic image formed on the electrostatic recording material is developed with an electroconductive powdery developer containing a fine powder of a magnetic material.

BRIEF DESCRIPTION OF THE DRAWING

FIG. 1-A is a diagram illustrating the step of forming an electrostatic latent image in the process of the present invention.

FIG. 1-B is a diagram illustrating the developing step in the process of the present invention.

FIG. 1-C is a diagram illustrating the fixing step in the process of the present invention.

FIG. 2-A is a diagram illustrating the wave form of a carrier wave of an alternating recording current.

FIG. 2-B is a diagram illustrating the distribution of static charges on a recording material.

FIG. 2-C is a diagram illustrating an image developed with a developer of the negative polarity.

FIG. 2-D is a diagram illustrating an image developed with a developer of the positive polarity.

FIG. 2-E is a diagram illustrating an image developed with a developer of the present invention.

DETAILED DESCRIPTION OF THE PREFERRED EMBODIMENTS

Referring now to FIGS. 1-A, 1-B and 1-C illustrating the steps of the process of the present invention, an output device 3 for transmitting an alternating recording signal, namely a high frequency signal formed by amplifying and modulating an image signal, is connected to a recording electrode (recording stylus) 1 and a counter electrode 2. Between the electrodes 1 and 2, an electrostatic recording material 4 is disposed so that it is electrically connected to the electrodes 1 and 2. In general, the electrostatic recording material 4 comprises a dielectric material layer 5 and an electroconductive layer 6, and the electroconductive layer 6 is located in contact with or in the vicinity of the counter electrode 2 and the dielectric material layer 5 is located in contact with or in the vic of the recording electrode 1. By relatively moving the recording electrode 1 and the electrostatic recording material 4 and applying an alternating recording signal between the two electrodes 1 and 2, an electrostatic latent image 7 charged alternately with charges of reverse polarities is formed on the dielectric material layer 5 depending on the frequency of the recording signal.

At the subsequent developing step shown in FIG. 1-B, the electrostatic latent image 7 formed on the electrostatic recording material 4 is developed with a magnetic electroconductive powdery developer 8. In general, this magnetic electroconductive powdery developer 8 is held in the form of a magnetic brush on a developing roller 9 having a magnet (not shown) disposed in the interior thereof, and when a spike of the magnetic brush falls in contact with the surface of the dielectric material layer of the electrostatic recording material 4, a visible toner image 10 is formed.

At the final fixing step shown in FIG. 1-C, the electrostatic recording material 4 having the visible toner image 10 formed thereon is fed between a pair of press rollers 11 and fixation of the visible toner image 10 is performed under pressure to form a fixed image 12.

The reason why such troubles as blurring, tailing, fogging and Moiré are effectively eliminated by the combined use of an alternating current recording signal and a magnetic electroconductive powdery developer according to the present invention has not been completely elucidated. However, we presume that such effect will probably be attained according to the following mechanism.

More specifically, when a recording signal having an alternating wave form as shown in FIG. 2-A is applied to the recording material 4, positive charges ⊕ and negative charges ⊖ are alternately formed at a certain interval determined according to the frequency of the recording signal and the scanning speed at the recording step. Particles of developers heretofore used for the electrostatic recording have charges of a certain polarity under application conditions. For example, when a powdery developer 13 having a negative polarity is used for development, as shown in FIG. 2-C, areas corresponding to positive charges on the recording material are selectively developed, and when a powdery developer 14 having a positive polarity is used for development, as shown in FIG. 2-D, areas corresponding to negative charges on the recording material are selectively developed. Therefore, according to known alternating current recording methods, only dotty toner images are formed, and a difference is brought about between the edge of an electrostatic latent image and the edge of an actually formed image because of the phase of the recording current or the polarity of the toner used, whereby the above-mentioned Moiré is caused to occur.

In contrast, when an electroconductive magnetic powdery developer 15 is used for development according to the present invention, since the developer per se is electrically conductive, charges having a polarity reverse to the polarity of charges of the electrostatic image on the recording material are readily induced in the developer powder through a developing roller acting as the developing electrode or a conducting passage formed among particles of the developer, and as a result, as shown in FIG. 2-E, both areas of positive charges and areas of negative charges on the recording material are uniformly developed by the developer powder, and formation of a dotty image as mentioned above or occurrence of Moiré can be effectively prevented.

Moreover, since a high frequency signal is used according to the present invention, induction of charges of the same or reverse polarity on areas other than areas of the electrostatic latent image is not caused and hence, occurrence of blurring or fogging can be effectively prevented. Still further, since charges are not accumulated on recording equipments and the like, the phenomenon of so-called tailing is not caused to occur.

The kind of the electrostatic recording material is not particularly critical in the present invention so far at it comprises a dielectric material layer and an electrically conductive layer. For example, layers having a thickness of 5 to 15μ and being composed of members selected from vinyl chloride-vinyl acetate copolymers, methacrylic resins, vinyl ether resins, vinyl acetate-crotonic acid resins, styrene polymers, acrylic resins, silicone resins, styrene-butadiene copolymers, chlorinated rubbers, alkyd resins and cellulose derivatives may be used as the dielectric material layer in the present invention. As the electroconductive layer, there may be used an electroconductive substrate having a volume resistivity of $10^6$ to $10^9$ Ω-cm, for example, a paper substrate which has been rendered electrically conductive by the treatment with at least one member selected from cationic, anionic and non-ionic polymeric conducting agents, water-soluble inorganic salts, various surface active agents and organic moisture-absorbing agents such as glycerin.

A high frequency signal formed by amplifying and modulating an image signal is directly used as the alternating current recording signal to be applied between the two electrodes. One advantage of the present invention is that this high frequency signal need not be converted to a direct current signal. The frequency of the carrier wave of the high frequency signal is not particularly critical in the present invention so far as charges are generated on the dielectric material layer. In general, a high frequency of 5 to 1000 KHz, especially 10 to 800 KHz, is advantageously selected and used depending on the scanning speed adopted for recording. The voltage to be applied is appropriately chosen within the range of 300 to 1500 V r.m.s., especially 400 to 1300 V r.m.s., depending on the kind and thickness of the dielectric material layer.

When the recording speed is low, one stylus can be used as the recording electrode (recording stylus), but when the recording speed is high, electrodes arranged in one line or a plurality of lines (pin electrodes and pin matrix electrodes) and letter type electrodes can be preferably employed.

Relative scanning of the recording electrode and the recording material can be accomplished by any of known scanning methods, for example, a cylinder-rotating scanning method, a disc-rotating scanning method, a belt-driving scanning method, a spiral cylinder-rotating scanning method and a recording head array subsequent change-over scanning method. These scanning methods are described in detail in the report of Mr. Yoshida published in Image Techniques, August 1971, pages 56 to 66.

The speed for relative scanning of the recording electrode and the recording material is varied depending on the frequency of the carrier wave of the high frequency recording signal, but in general, it is preferably chosen within the range of 0.5 to 100 m/sec, especially 1 to 50 m/sec.

Any of powdery developers having a property of being magnetically attracted, an electrically conductive property and a fixing property can be used as the magnetic electroconductive powdery developer in the present invention. In general, a preferred powdery developer having the above three properties is composed of a fine powder of an inorganic magnetic material, a conducting agent and a fixing agent.

As the inorganic magnetic materials customarily used in the art, there can be mentioned, for example, triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). In the present invention, these magnetic materials may be used singly or in the form of a mixture of two or more of them. As the magnetic material especially suitable for attaining the objects of the present invention, there can be mentioned a fine powder of triiron tetroxide or $\gamma$-diiron trioxide.

As the conducting agent, there may be employed fine powdery conducting agents such as carbon black, aluminum powder, copper powder and silver powder, and polymeric conducting agents. Use of conducting agents of the former type, especially carbon black, is preferred.

Any of natural, semi-synthetic and synthetic resins, rubbers and waxes that become adhesive or sticky under application of heat or pressure can be used as the fixing agent in combination with the above-mentioned fine powdery magnetic material and conducting agent. Such resinous binders may be either thermoplastic resins or uncured products or precondensates of thermosetting resins. Valuable natural resins include balsam resins, rosin, shellac and copal. These natural resins may be modified with at least one member selected from vinyl resins, acrylic resins, alkyd resins, phenolic resins, epoxy resins and oleoresins. As the synthetic resin, there can be mentioned, for example, vinyl resins such as vinyl chloride resins, vinylidene chloride resins, vinyl acetate resins, vinyl acetal resins, e.g., polyvinyl butyral, and vinyl ether polymers, acrylic resins such as polyacrylic acid esters, polymethacrylic acid esters, acrylic acid copolymers and methacrylic acid copolymers, olefin resins such as polyethylene, polypropylene, polystyrene, hydrogenated styrene resins, ethylene-vinyl acetate copolymers and tyrene copolymers, polyamide resins such as nylon 12, nylon 6 and polymeric fatty acid-modified polyamides, polyesters such as polyethylene terephthalate/isophthalate and polytetramethylene terephthalate/isophthalate, alkyd resins such as phthalic acid resins and maleic acid resins, phenol-formaldehyde resins, ketone resins, coumarone-indene resins, amino resins such as ureaformaldehyde resins and melamine-formaldehyde resins, and epoxy resins. These synthetic resins may be used in the form of a mixture of two or more of them, for example, a mixture of a phenolic resin and an epoxy resin or a mixture of an amino resin and an epoxy resin.

As the natural or synthetic rubbery material, there can be mentioned, for example, natural rubber, chlorinated rubber, cyclized rubber, polyisobutylene, ethylene-propylene rubber (EPR), ethylene-propylenediene rubber (EPDM), polybutadiene, butyl rubber, styrene-butadiene rubber (SBR) and acrylonitrilebutadiene rubber (ABR).

As the natural, synthetic or modified wax, there can be mentioned, for example, paraffin wax, petrolatum, polyethylene wax, microcrystalline wax, bees wax, hydrous lanolin, cotton wax, carnauba wax, montan wax, hydrogenated beef tallow, higher fatty acids, higher fatty acid amides, soaps and other higher fatty acid derivatives.

In general, in the present invention it is preferred to use a developer comprising 100 parts by weight of a fine powder of a magnetic material, 10 to 150 parts by weight, especially 25 to 100 parts by weight, of a binder and 1 to 30 parts by weight, especially 3 to 20 parts by weight, of a conducting agent. A binder composed solely of a resin or a binder comprising 55 to 95% by weight of a resin and 5 to 45% by weight of a wax is preferably employed. The developer is obtained by dispersing a fine powder of a magnetic material and at least a part of a conducting agent into a melt or solution of a binder as mentioned above and shaping the dispersion into fine particles. If desired, in order to further enhance the electric conductivity or flowability of the so formed particles, the remainder of the conducting agent is dry-blended in the particles to crumb or embed the conducting agent on the surfaces of the particles.

The electroconductive magnetic powdery developer that is suitably used for attaining the objects of the present invention has a particle size of 1 to 30$\mu$, especially 2 to 10μ, and a volume resistivity lower than $10^9$ Ω-cm, especially $10^4$ to $10^8$ Ω-cm.

The so-called magnetic brush developing method is used for developing an electrostatic latent image on the recording material with the above-mentioned electroconductive magnetic developer. One of the features of the present invention is that a particular magnetic carrier need not be used for the development. According to the magnetic brush developing method, magnetic brushes of the electroconductive magnetic powdery developer are formed on a rotary sleeve having a magnet disposed in the interior thereof, and the surface of the recording material having an electrostatic latent image formed thereon is caused to fall in contact with these magnetic brushes, thereby to form a visible toner image. The surface of the rotary sleeve may be formed of either an electrically conductive material such as a metal or an electrically insulating material. In the former case, the surface of the rotary sleeve is earthed and a conducting passage is formed between the surface of the rotary sleeve and the spike of the magnetic brush as the developing electrode. In the latter case, a conducting passage is formed between the surface of the rotary sleeve and the magnetic brush composed of the developer particles so that charges having a polarity reverse to that of charges to be developed are induced on the spike of the magnetic brush.

An image of the developer particles formed on the recording material may be fixed on the surface of the recording material by optional fixing means, for example, pressure fixation, heating fixation and solvent fixation. According to the pressure fixing method, the fixation can be accomplished very easily at a high speed only by passing the recording material through a pair of pressure rollers. Further, no time is necessary for warming up the fixing apparatus. Accordingly, the pressure fixing method is very advantageous for attaining the objects of the present invention. In general, it is preferred that the linear pressure applied to the press rollers be at least 15 Kg per cm of the roller length, especially at least 30 Kg per cm of the roller length. Further, when the pressure fixing method is adopted, a developer comprising a mixture of a resin and a wax as the binder is advantageously used. According to the heating fixing method, fixation can be advantageously accomplished by contacting the recording material having a toner image with a roller equipped with heating means, and a roller having a heat-resistant and inactive coating composed of polytetrafluoroethylene, a silicone resin or the like and having an offset preventing agent, such as a silicone oil, applied to the surface of the coating is advantageously used as the heating roller. Such offset preventing agent may be incorporated into the developer per se instead of coating the offset preventing agent on the surface of the heating roller.

The electric recording process of the present invention can be advantageously applied to facsimile, electrostatic printing, a printer of a computor and the like, and it provides an effect of forming at high speeds recorded images free of such defects blurring, tailing, fogging and Moiré.

The present invention will now be described by reference to the following Examples that by no means limit the scope of the invention.

COMPARATIVE EXAMPLE 1

An acrylic resin was coated on a base paper having a thickness of 65μ and a volume resistivity of $3 \times 10^8$ Ω-cm (as measured at a temperature of 20° C. and a relative humidity of 58%) so that a coating having a thickness of about 8μ as measured after drying was formed, whereby an electrostatic recording paper was prepared. This recording paper was pasted to a signal receiving drum of an electrostatic recording machine, and a test chart No. 2 specified by the Academic Society of Images and Electronics was set to a signal emitting drum. The recording operation was carried out by applying a negative direct current voltage. The stylus used was a tungsten stylus having a diameter of 150μ, and the stylus pressure was 10 g. The line density was 10 lines per mm, and the frequency of the carrier wave was 10 KHz. The recording speed (scanning speed) was changed from 0.8 m/sec to 3.2 m/sec by 0.4 m/sec at one time. The recorded image was developed with a liquid developer and then fixed.

At a recording speed higher than 2.4 m/sec, tailing was conspicuous in 8-point letters of the developed image, and it was difficult to read 8-point Chinese characters with 10 or more strokes. Further, lines of the recorded image were broadened in width, and the resolving power and sharpness of lines of the recorded image were very low. Similar results were obtained even when the polarity of the applied voltage was changed to the positive polarity at the recording step. Further, even if a powdery dry developer was used instead of the liquid developer, obtained results were similarly poor and no gradation was observed.

COMPARATIVE EXAMPLE 2

The recording operation was carried out in the same manner as in Comparative Example 1 except that an amplified and modulated was directly applied to the recording paper as a recording signal without rectification. The recording speed was similarly changed from 0.8 m/sec to 3.2 m/sec, and development was carried out with a positive liquid developer or positive powdery dry developer. At a recording speed of 0.8 m/sec one cycle was 80μ and at a recording speed of 3.2 m/sec one cycle was 320μ, and alternating charges were formed for every half cycle in each case but charges observed after the developing step were negative.

In a line image recorded at a low recording speed, the recorded dot density was high and the resolving power was high, and troubles such as tailing were not caused at all irrespective of the recording speed. However, the image density was low as a whole, and with increase of the recording speed, since the image was a dot-recording image, it became difficult to read 8-point Chinese characters with 10 or more strokes. Furthermore, Moiré was caused on a resolving power-testing chart of Seimensstar. Thus, a recorded image of high quality could not be obtained according to the developing method of this Comparative Example.

EXAMPLE 1

In the same manner as in Comparative Example 2, an amplified and modulated wave was directly applied to an electrostatic recording paper. After the recording operation, development was carried out according to the method shown in FIG. 1-B by using an electroconductive powdery developer for heat fixation containing a fine powder of a magnetic material and the developed image was fixed by passing the recording material through between heating rollers.

The developer used was prepared in the following manner:

A composition comprising 34 parts by weight of an epoxy resin (Epiclon 4050 manufactured by Dainippon Ink Kagaku Kogyo Kabushiki Kaisha), 61 parts by weight of triiron tetroxide and 5 parts by weight of carbon black was added under agitation to 200 parts by weight of acetone. The mixture was blended and dispersed for 30 minutes by using a homogenizing mixer to obtain a dispersion for spray granulation. The dispersion was sprayed in hot air maintained at 130° C. to obtain dry spherical fine particles, and particles having a size of 5 to 40μ were collected by classification. Then, 0.1 part by weight of carbon black was incorporated in 100 parts by weight of the classified particles and homogeneously dispersed therein by a V-type mixer to form a developer.

The so formed recorded line image had a high density and a high resolving power and was free of such troubles as tailing and fogging. Even when the recording was conducted at a recording speed of 3.2 m/sec, 8-point Chinese characters with 10 or more strokes could easily be read. Further, Moiré was not caused at all and the gradation was sufficiently reproduced. Thus, a recorded image of high quality could be obtained in this Example.

EXAMPLE 2

The recording and developing operations were conducted in the same manner as in Example 1 except that a magnetic electroconductive powdery developer for pressure fixation was used. The electrostatic recording paper was then passed through press rollers as shown in FIG. 1-C to effect pressure fixation. A recorded image of high quality could be obtained as in Example 1.

The developer used was prepared in the following manner:

A composition comprising 35 parts by weight of a hydrogenated styrene resin (Arkon P-125 manufactured by Arakawa Rinsan Kagaku Kogyo Kabushiki Kaisha), 15 parts by weight of an epoxy resin (Epikote 1002 manufactured by Shell Chemical Co.), 20 parts by weight of a fatty acid amide (Diamit 0-200 manufactured by Nippon Kasei Kabushiki Kaisha; having a melting point higher than 70° C.) and 20 parts by weight of an ethylenevinyl acetate copolymer (Evaflex 410 manufactured by Mitsui Polychemical Kabushiki Kaisha) was dissolved under agitation in 800 parts by weight of heated toluene. Then, 260 parts of triiron tetroxide and 10 parts by weight of carbon black were added to the solution, and the mixture was blended and dispersed for 30 minutes by using a homogenizing mixer to obtain a dispersion for spray granulation.

The dispersion being maintained at 70° C. was sprayed in hot air maintained at 150° C. to obtain dry spherical fine particles.

Particles having a particle size of 5 to 40μ were collected by classification, and 0.08 part by weight of carbon black was added to 100 parts by weight of the particles and the mixture was homogeneously blended by a V-type mixer to obtain a developer.

EXAMPLE 3

An electrostatic recording paper prepared by forming a dielectric material recording layer by using a vinyl chloride-vinyl acetate copolymer instead of the acrylic resin used in Comparative Example 1 was pasted on the signal receiving drum of the electrostatic recording machine used in Comparative Example 1. A signal voltage of an amplified and modulated wave was directly applied to the electrostatic recording paper. The stylus used was a tungsten stylus having a diameter of 150μ and the stylus pressure was 10 g. The line density was 13 lines per mm and the recording speed was 10 m/sec. The frequency of the carrier wave was 100 KHz. After recording, development was carried out by using the same magnetic electroconductive powdery developer for heat fixation as used in Example 1, and the developed image was fixed under heating to obtain a high density recorded image free of such troubles as tailing, blurring, fogging and Moiré.

EXAMPLE 4

The recording and developing operations were conducted in the same manner as in Example 3 except that the same magnetic electroconductive powdery developer for pressure fixation as used in Example 2 was used for the development. After the development, fixation was conducted under pressure to obtain a high density recorded image free of such troubles as tailing, blurring, fogging and Moiré.

What we claim is:

1. An electric recording process comprising relatively scanning a recording electrode on an electrostatic recording material which is electrically connected between said recording electrode and a counter electrode, applying an electric recording signal between said two electrodes to form an electrostatic image signal between said two electrodes to form an electrostatic image on the electrostatic recording material, developing the so formed electrostatic image with a developer and fixing the developed image, applying an alternating current high frequency signal formed by modulating an image signal by a high frequency carrier wave as the electric recording signal and developing the electrostatic image with a single-component electroconductive magnetic developer.

2. An electric recording process according to claim 1 wherein a carrier wave of the high frequency signal has a frequency of 5 to 1000 KHz.

3. An electric recording process according to claim 1 wherein the high frequency signal has a voltage of 400 to 1300 V r.m.s.

4. An electric recording process according to claim 1 wherein the electrostatic image is developed with a magnetic brush of the electroconductive powdery developer.

5. An electric recording process according to claim 1 wherein the electroconductive powdery developer is a fine particulate developer comprising 100 parts by weight of a fine powder of an inorganic magnetic material, 25 to 100 parts by weight of a binder and 3 to 20 parts by weight of a conducting agent.

6. An electric recording process according to claim 5 wherein the fine particulate developer has a volume resistivity of $10^4$ to $10^9$ Ω-cm.

7. An electric recording process according to claim 1 wherein the developer has a volume resistivity of $10^4$ to $10^9$ Ω-cm.

8. An electric recording process comprising relatively scanning a recording on an electrostatic recording material which comprises a dielectric material layer and an electroconductive layer and is electrically connected between said recording electrode and a counter electrode at a relative scanning speed of 0.5 to 100 m/sec, applying an electric recording signal between said two electrodes to form an electrostatic image on the dielectric material layer of the electrostatic recording material, said electric recording signal being an alternative current signal having a frequency of 10 to 800 KHz and a voltage of 300 to 1500 V r.m.s. formed by modulating an image signal by high frequency carrier wave, developing the so formed electrostatic image with a developer, said developer being a single-component electroconductive magnetic developer comprising 100 parts by weight of a fine powder of a magnetic material, 25 to 100 parts by weight of a binder and 3 to 20 parts by weight of a conducting agent, and fixing the developed image.

* * * * *